US006628894B2

(12) United States Patent
Winter et al.

(10) Patent No.: US 6,628,894 B2
(45) Date of Patent: Sep. 30, 2003

(54) PORTABLE WARM WATER HEATER SYSTEM

(76) Inventors: Ken S Winter, 2816 6th Line, Innisfil, Ontario (CA), L9S 4S4; Roger S. Winter, 2816 6th Line, Innisfil, Ontario (CA), L9S 4S4

( * ) Notice: Subject to any disclaimer, the term of this patent is extended or adjusted under 35 U.S.C. 154(b) by 29 days.

(21) Appl. No.: 09/871,141

(22) Filed: Dec. 13, 2001

(65) Prior Publication Data

US 2003/0113107 A1 Jun. 19, 2003

(51) Int. Cl.[7] ..... F24H 1/20
(52) U.S. Cl. ..... 392/447; 392/441; 392/444
(58) Field of Search ..... 392/441, 444, 392/447, 449, 451, 465

(56) References Cited

U.S. PATENT DOCUMENTS 4,185,187 A * 1/1980 Rogers ..... 392/489
6,161,228 A * 12/2000 Wietecha ..... 5/625
6,321,036 B1 * 11/2001 Huang ..... 392/453

* cited by examiner

*Primary Examiner*—Thor Campbell

(57) ABSTRACT

A low-cost warm water heater for use in portable toilets, to provide unblended warm water for hand washing provides a small quantity of warm water at a predetermined temperature, the flow being sensibly at ambient pressure. The water system is supplied by hand or foot pump, or gravity feed, using a low power electric immersion heater, within a small, fabricated plastic casing that is of standard fittings, solvent welded to provide a substantially vandal-proof, child-proof heater. Provision of a cold water feed with vacuum break protects the heater against being siphoned dry. Snap-in hose connections simplify assembly and maintenance. While electrically protected by the plastic case construction, electrical ground-fault protection may also be utilized. A stand-alone embodiment incorporates a diaphragm foot pump to provide spurts of warm water.

14 Claims, 4 Drawing Sheets

54'
50
74
70
72
76
68
64
48
46
56
61
60
52
66
58
54
49

48
48'
44
46
42
49

PORTABLE WARM WATER HEATER SYSTEM

BACKGROUND OF THE INVENTION

1. Field of the Invention

This invention is directed to a warm water system incorporating a portable water heater, and in particular to a system water heater used in combination with a portable toilet 2. Description of the Prior Art Hand washing facilities have been provided in portable toilets for a number of years, using cold water. Under cold weather conditions the provision of a brine solution enables such facilities to operate effectively down to as low as zero F degrees (minus 20 C degrees). Also, heaters and heater lights may be used in such circumstances.

Electric water heaters have been in household use for many years, most usually consisting of a heating element immersed within a water storage tank. Other, continuous flow, tankless systems are known, having through-flow arrangements that operate at mains pressure, with an outlet shutoff, and which utilize high temperature plastic components.

Known ones of these are complex in structure, requiring costly specialty injection moldings in their construction.

SUMMARY OF THE INVENTION

The present invention provides a warm water system having a compact, low cost in-line water heater mainly constructed from off-the-shelf component parts.

The subject heater includes a tubular plastic body having closure end caps welded thereto forming a casing.

This construction renders the water heater substantially tamper and vandal proof, being thus safe for children.

The thermal gradient across the thickness of the plastic walls substantially precludes any hot outer surfaces. This is particularly true when a thermostat setting for warm water is selected, in the range of about 68 to 100 F degrees, as opposed to the more usual household setting of some 120 to 130 F degrees.

It will be understood that the warm water is used directly, and does not require blending with cold water, as in the more usual practice.

The heater plastic body, being of polyvinylchloride (PVC) is fire retardant, such that, in the event of the heater becoming dried out, there is an extremely low probability of a fire ensuing from overheating of the heating element that would follow such a dry-out.

In the preferred embodiments, the subject system operates at atmospheric pressure. The water supply may be admitted by way of a hand or foot operated pump, or as a gravity feed, thus enabling the outlet (or "demand end") to operate without a shut-off tap or other valve, so that the system remains substantially unpressurized at all times.

However, the casing is sufficiently strong to withstand normal household pressures of up to about 100 psi gauge.

The subject system provides a compact, low temperature installation that can be readily mounted on a wall, by way of a U-shaped plastic pipe support bracket or brackets.

The adoption of an all-plastic heater construction, combined with an electric immersion heater element, provides full electrical insulation. Safety may be further enhanced by the use of a ground-fault protected electrical outlet. Such further provision may be considered redundant. The heater is preferably suspended vertically, with the heating element depending downwardly from the upper end of the heater and projecting well into the heating chamber of the heater. The cold water supply is directed to the lower end of the chamber, to flow upwardly, past the heater element to the unrestricted warm water outlet adjacent the upper end of the heater casing. By locating the warm water outlet somewhat below the top of the heating chamber, there is provided an air cushion zone where entrained air and water vapor collects. This cushion zone facilitates a smooth flow of warm water when further cold water is admitted to the heater. Also, under severe freeze-up conditions that may be encountered, the cushion zone provides an expansion space as ice forms within the heater chamber, thus mitigating the adverse effects of such freeze-up.

In a preferred embodiment, the cold water supply is connected to the top outer end of the heater casing, having a transfer tube within the chamber to pass the cold water downwardly towards the bottom of the heating chamber.

A bleed hole in the wall of the transfer tube, located adjacent its upper end, serves as a siphon-break, in the event that the cold water supply line should become drained, which otherwise would tend to siphon out the contents of the heater. In such an eventuality of supply line drain-down, any consequential siphoning is terminated by the bleed hole, which admits air into the line, thereby breaking the vacuum and terminating the siphoning action, such that the heater chamber remains substantially full, thus protecting the heater element against rapid burn-out.

Without such protection, an energized but dry heater element would probably burn out within three or four minutes.

The size of the heating chamber and the rating of the heating element are such that an adequate individual hand washing supply is provided. A recovery time of about 90 seconds between washings has been found to be practical. This value can be varied by changes in the respective parameters of water temperature, heating chamber capacity, and the power rating of the heating element.

The use of a foot pump by the user enables warm water to be dispensed in spurts, consonant with the washer's requirements, while conserving water.

The use of a brine solution to off-set freezing of the cold water supply has the added advantage of improved antiseptic conditions.

A number of variants of the system include a free-standing combination unit incorporating a water tank with a built-in foot pump, surmounted by a wash hand-basin, having the water heater unit secured to the side of the water tank.

Other uses of the system, as for camping, may involve a tree-mounted tank with a variable outlet valve, feeding a subject heater that supplies warm water to a bowl on a picnic table, by way of a molded hook-over delivery tube.

BRIEF DESCRIPTION OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figure 1:
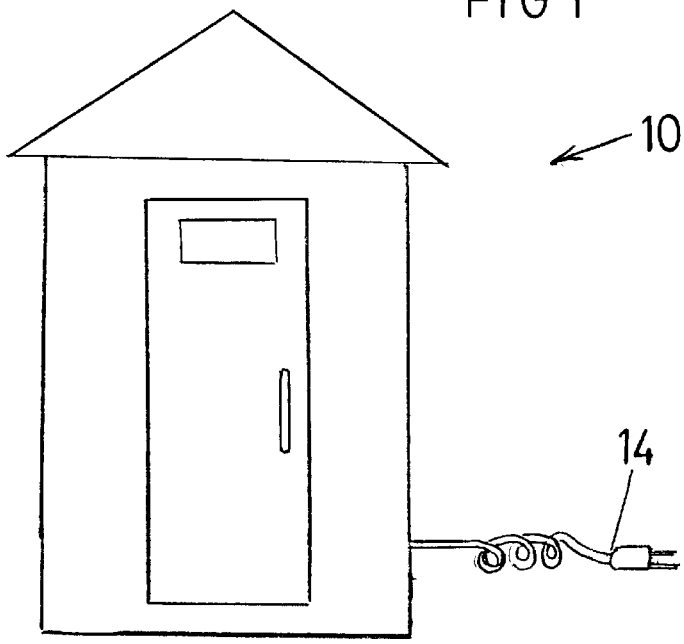
FIG. 1 is a frontal elevation of a portable toilet of a type incorporating the subject warn water system of the present invention.
Figure 2:
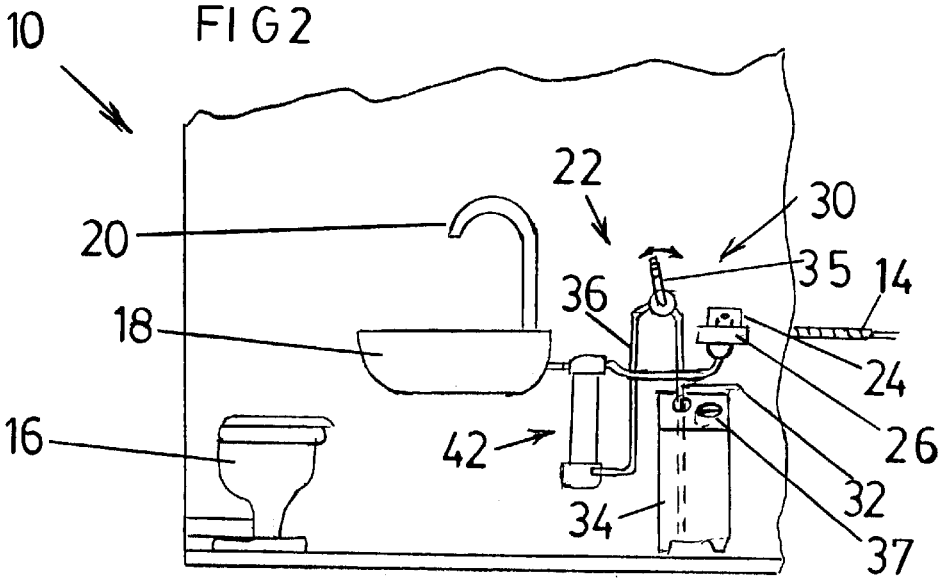
FIG. 2 is a schematic elevational view of the elements of a warm water system in accordance with the present invention.

Referring to FIGS. 1 and 2, an enclosed portable toilet structure 10 of the general type frequently referred to as a "Johny-on-the-Spot", has an electric power connection 14, at household voltage.

In FIG. 2 there are illustrated (ostensibly located within a portable structure 10), a toilet 16, and a wash-hand basin 18, with an unfettered swan-neck warm water outlet 20.

A warm water supply 22 in accordance with the invention includes a water supply tank 34 and obtains electric power from the connection 14, by way of an electric outlet 24, illustrated as serving a ground-fault circuit breaker 26. It will be understood that the provision of ground-fault protection may be a requirement in some jurisdictions, and optional in others. In view of the above-disclosed use of an electrically non-conducting plastic heater construction, the circuit breaker 26 may be considered redundant by some, and excellent safety practice by others.

Figure 3:
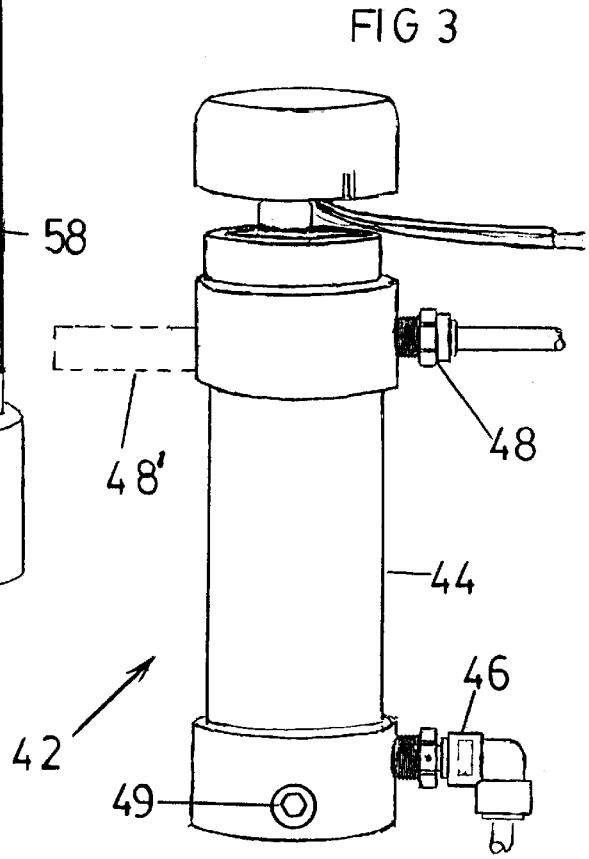
FIG. 3 is a frontal view in elevation of a subject heater unit first embodiment.

The supply 22 is illustrated as having a hand wobble pump 30 having an inlet line 32 connected to a water tank 34, a pump actuating handle 35 and a delivery line 36 connecting with a first embodiment warm water heater 42 (see also FIG. 3). An electric cord connects outlet 24 to the heater 42. The water tank 34 has a filler opening 37 for filling the tank 34 with cold water. The heater 42 has a generally vertical cylindrical body 44, with a cold water inlet 46 and warm water outlet 48, located at the respective lower and upper ends of the heater. A drain plug 49 enables the unit 42 to be emptied when out of use, or prior to very low ambient temperatures. Details of the construction of heater 42 correspond substantially with those illustrated in FIG. 4, except for the low-end location of cold water inlet 46 of heater 42.

Shown in phantom is the location 48 for an over-temperature, over-pressure release valve that may be stipulated in some jurisdictions, but which would appear to be totally redundant in the present mid-temperature, ambient-pressure system.

The cold water inlet 46 and warm water outlet 48 preferably consist of coupling reducers, that permit the use of snap-on couplings to rapidly connect and disconnect the heater.

Figure 4:
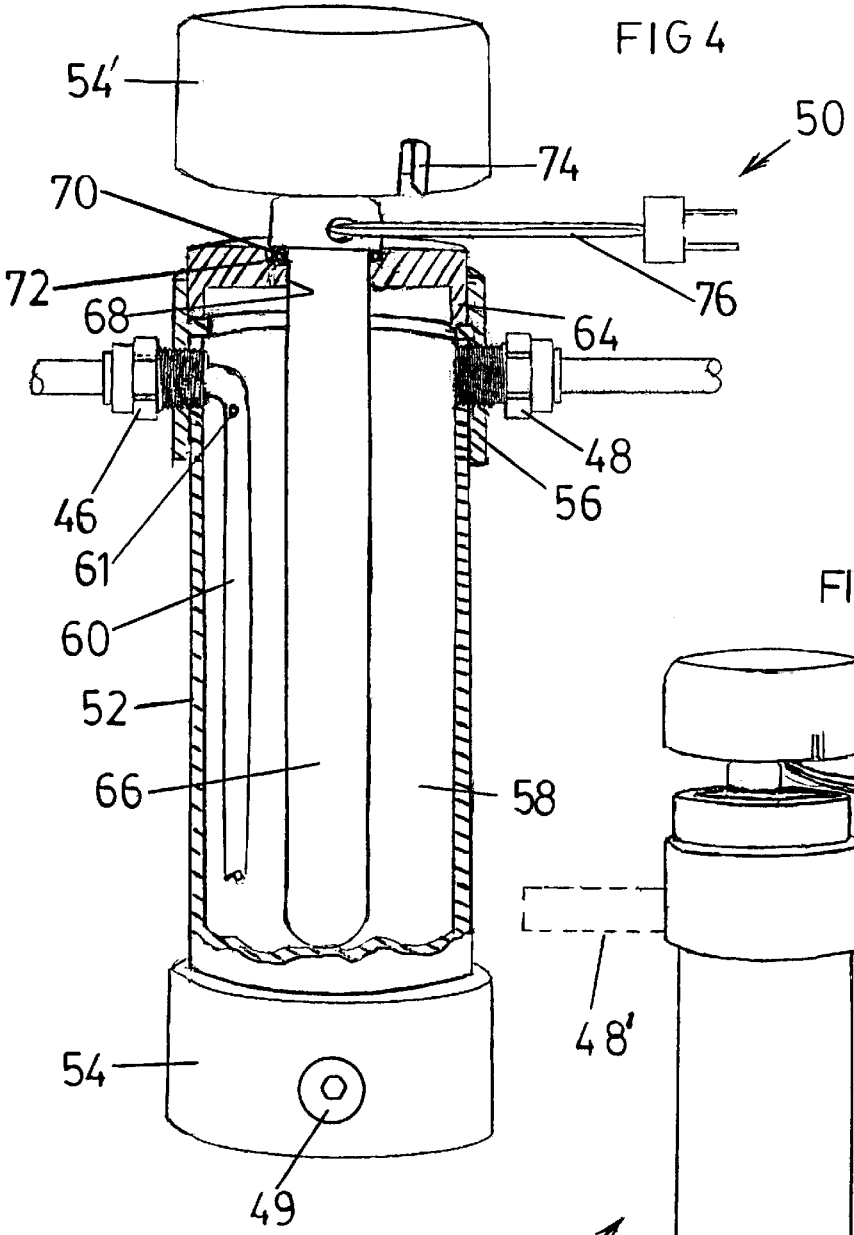
FIG. 4 is a front elevation, in diametrical section of a second heater embodiment.

Referring to FIG. 4, the second heater embodiment 50 has a tubular body portion 52, for which water supply quality piping of PVC schedule 40 is eminently suitable.

A regulation end-cap 54 is solvent welded to the lower end of body portion 52.

A coupling 56 serves to extend the upper end of body portion 52, being solvent welded thereto.

A cold water inlet 46 is threaded through the walls of coupling 56 and body portion 52.

Within the chamber 58 of heater 50 a plastic transfer tube 60 connects the cold water inlet 46 to the lower end of heater chamber 58, serving to conduct cold water in displacing relation with the overlying heated water.

A small bleed aperture 61 located adjacent the top of the transfer tube 60 provides protection against inadvertent emptying of the heater 50 by siphonage.

A warm water outlet 48 is threaded through the walls of coupling 56 and body portion 52.

An intermediate end cap 64 is solvent welded within the upper end of coupling 56.

An electric heating element 66 is supported in a central aperture 68 that extends through the end cap 64. An elastomeric O-ring 70 about the element 66, located within a recess 72 in the end cap aperture 68, serves to seal against air leakage from the heater chamber 58.

An upper end cap 54', having a slot 74 for an electric cord 76 of heating element 66, is solvent welded to the projecting upper end of the intermediate end cap 64, to totally enclose the heater. In use, operation of the pump 30 displaces cold water from the tank 30 into the heater 42 or 50. The heating element 66 is then electrically connected to its supply, by way of electric cord 76, and the water is heated to a predetermined temperature in the specified range. This heating usually takes about 90 seconds, using a 300 watt heater such as the Art A 718LR 52272 model heater operating on a 120 volt a.c. supply, as provided by the Thermal Compact company.

It will be understood that premature connection of the cord 76, before the heater 42 or 50 has been filled with water, will lead rapidly to destructive overheating of the heating element 66. A further or delayed operation of the pump 30 displaces cold water from the tank 34, which water flows into the respective heater 42 or 50, causing a steady displacement of warm water upwardly and out through the swan-neck water outlet 20, over the hands of the user.

Figure 5:
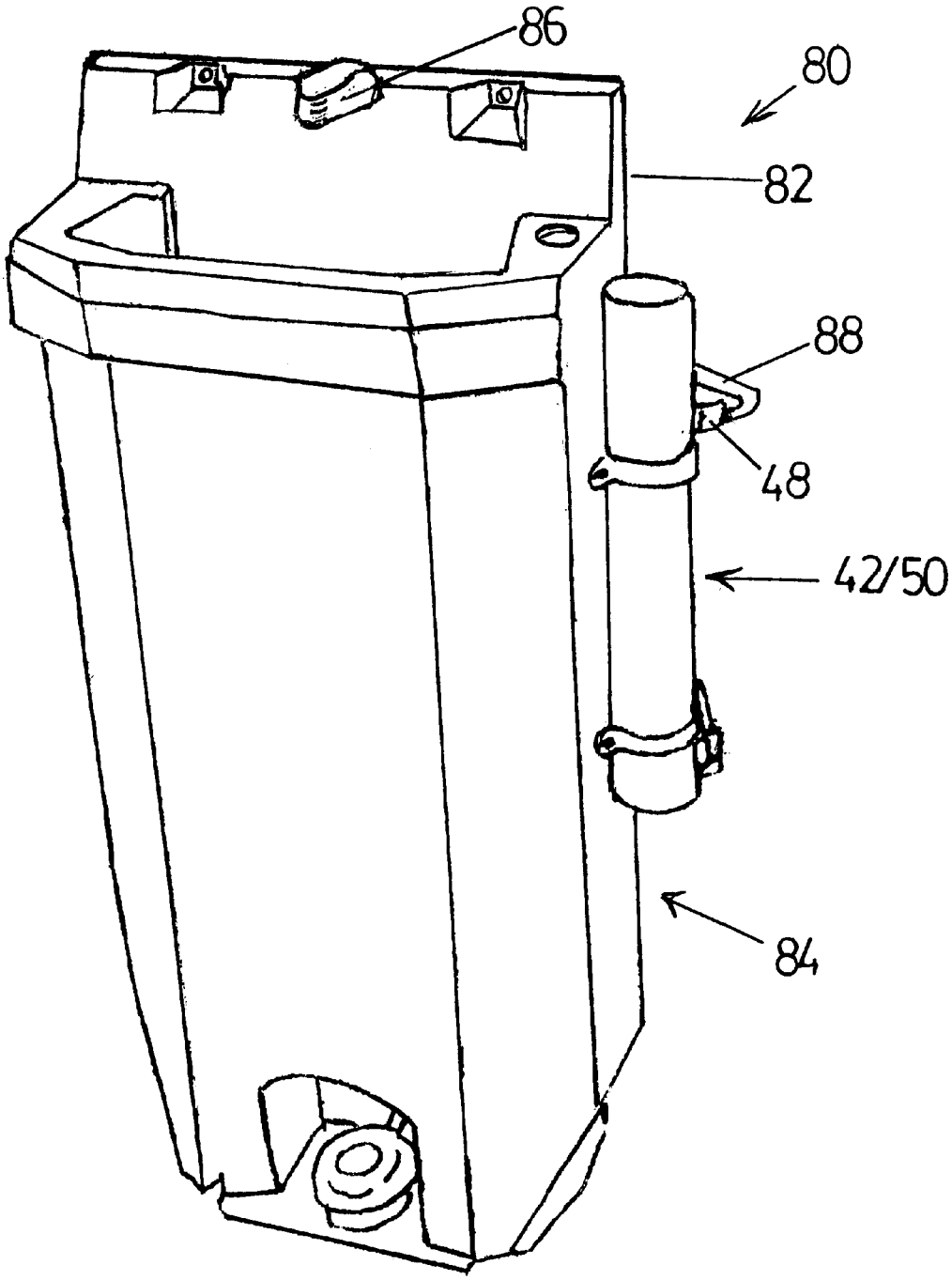
FIG. 5 is a front elevation, in perspective, of a fully portable, self-contained, free standing unit in accordance with the present invention; and, FIG. 6 is a representation of another system embodiment, in a camping environment.

Turning to FIG. 5, a fully portable system embodiment 80 has a hand wash-basin portion 82 integrated with an underlying water storage tank portion 84, which serves as a support pedestal. A warm water heater 42/50 is mounted on the side of the tank portion 84. It will be understood that while either of the embodiments 42 or 50 may be used, the heater embodiment 50 is preferred, on account of its anti-siphon characteristics, which protect the heater against burnout, in the event that the cold water supply pipe should become disconnected.

An outlet flow head 86 mounted on the wash-basin portion 82 is connected by way of pipe connection 88 to the warm water outlet 48 of the heater 42/50

An outlet drain (not shown) from the wash basin portion 82 may be directed to a holding tank for the associated toilet.

Figure 6:
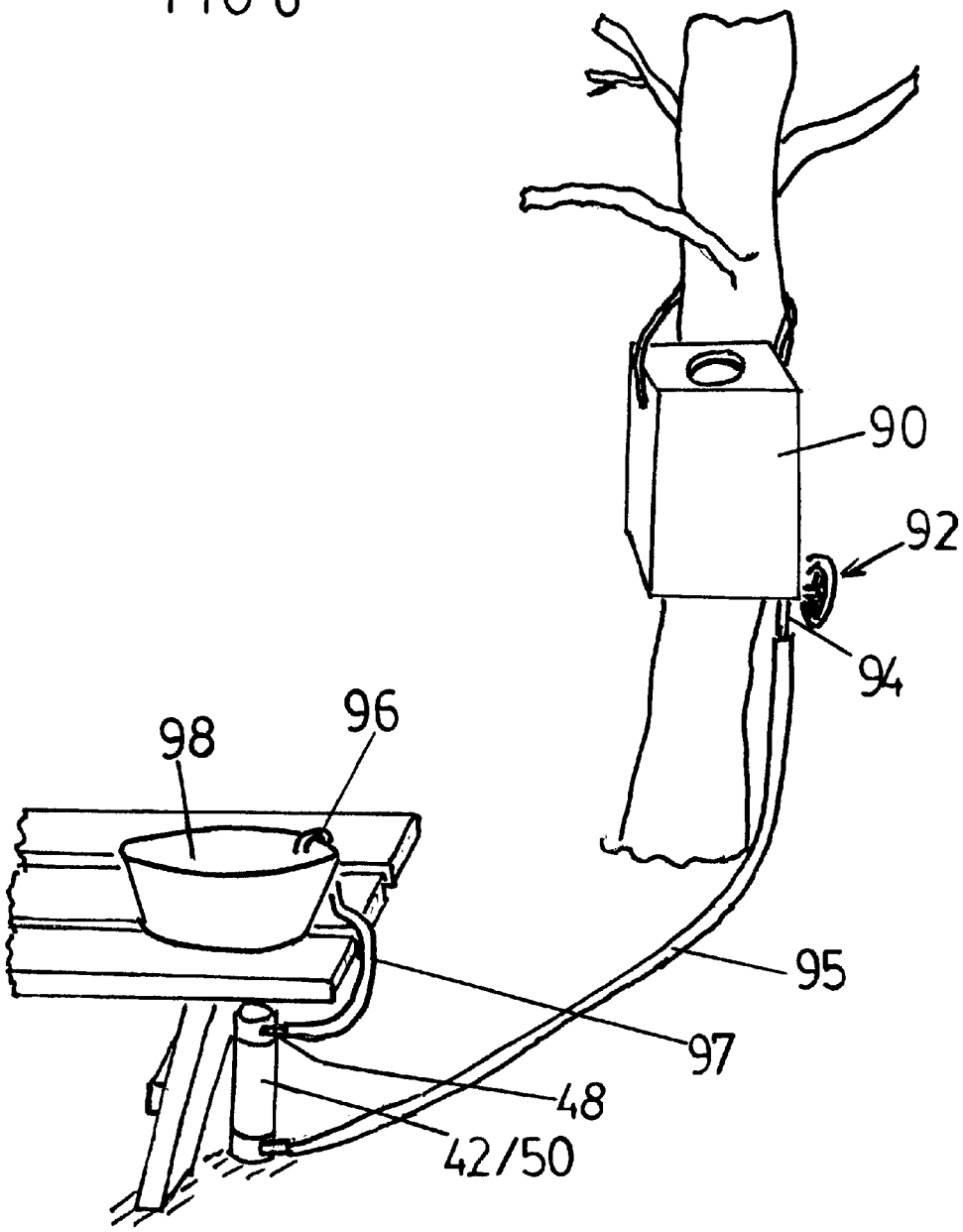

In the system embodiment envisaged in FIG. 6, at such as a campsite, a cold water tank 90 is suspended in an elevated position from a support such as a tree. The tank 90 has an adjustable outlet valve 92, enabling selective control of the rate of flow of cold water from the tank 90. The tank outlet 94 connects by way of plastic hose line 95 with a warm water heater, preferably of the improved anti-siphon type 50, described above. The heater outlet 48 connects by plastic hose line 97 to a molded hook-over delivery tube 96 which can be hooked over the rim of a bowl 98.

In use, the valve 92 may be closed, or be adjusted to a desired flow rate.

In describing either of the two pump types as being "manually operable" it will be understood that this term includes hand, foot or knee operation of a water pumping modality.

Owing to the substantially unpressurized system embodiments, with low rates of water transfer, and the avoidance of substantial back pressure when water is displaced in the operation of the system, low cost, unreinforced plastic tubing may be used, with slip-on connections and an avoidance of hose clamps.

What is claimed is:

1. A warm water heater for supplying warm water for direct use, consisting of an enclosed housing with an interior chamber, having an inlet for cold water, and an outlet for warm water, an electric immersion heater located within and secured one end of the chamber, adjacent said cold water inlet, a transfer tube within said chamber connected to said inlet, to transfer cold water entering the heater to the other end of the chamber, said transfer tube having an air bleed hole adjacent the top end of the tube, in perforating relation therewith, in use to admit into the tube upon the occurrence of drain-down of said cold water inlet initiating a siphon effect on water contents of said housing, and to maintain said immersion heater substantially submerged said immersion heater being thermostatically controlled to provide, in use, warm water in the temperature range of about 68 to 100 F. degrees.

2. The heater as set forth in claim 1, wherein said housing is of electrically non-conducting plastic, consisting of a plurality of standard components in bonded relation to form a unitary assembly.

3. The heater as set forth in claim 1, wherein said cold water inlet is located adjacent one end of said housing and said immersion heater is located at the other end of said housing.

4. The heater as set forth in claim 1, said warm water outlet being located adjacent the top end of said chamber, being spaced axially downward therefrom, in use to form an air space at said chamber top end.

5. The heater as set forth in claim 1, said housing being of PVC tubular components, in solvent-bonded relation.

6. The heater as set forth in claim 1, said water inlet and said water outlet including quick disconnect fittings, to facilitate rapid connection and disconnection of water hoses thereto.

7. The heater as set forth in claim 1, in combination with a free-flow outlet, whereby in use said heater operates at ambient pressure.

8. The combination as set forth in claim 7, including water displacement means, in use to provide cold water to said heater inlet at a predetermined moderate rate of flow, in displacing relation with warm water present within the heater.

9. The combination as set forth in claim 8, said water displacement means including reservoir means connected with and positioned above said heater, in use to supply cold water to said heater.

10. The combination as set forth in claim 9, said reservoir means means including manually operated flow control means, to selectively regulate the flow of cold water to said heater.

11. The combination as set forth in claim 8, further including a portable toilet building having a toilet and wash hand basin.

12. A free-standing warm water system installation, having a water tank located in a lower portion of the installation, surmounted by a wash handbasin receptacle; filler means for admitting water to said water tank; a water heater within the tank to heat cold water to a pre-determined maximum warm temperature enabling safe unblended use of the warm water in hand washing by a user; and unobstructed water outlet means to direct warm water from said water heater in substantially unrestricted free flow into said handbasin, in response to the admission of a like quantity of cold water into the installation.

13. A free-standing warm water system having a water tank lower portion surmounted by a washing receptacle; filler means for admitting water to said water tank; manually operable pump means connected to said water tank to receive inlet water from the pump means; a water heater connected with said pump means, having an inlet to receive cold water therefrom; a transfer tube within said heater connected to said inlet, to transfer cold water entering the heater to the other end of the heater, said transfer tube having an air bleed hole adjacent the top end of the tube, in perforating relation therewith, in use to admit air into the tube upon the occurrence of drain-down of said cold water inlet initiating a siphon effect on water contents of said heater, to maintain said heater substantially full of water, and water outlet means to receive warm water heated to a pre-determined maximum temperature from said water heater.

14. The free-standing water system as set forth in claim 13, in combination with a portable building having a toilet and an associated holding tank, to receive waste water from said washing receptacle.

* * * * *